US009824640B2

(12) United States Patent
Inamura

(10) Patent No.: US 9,824,640 B2
(45) Date of Patent: Nov. 21, 2017

(54) IMAGE DISPLAY APPARATUS AND CONTROL METHOD THEREFOR FOR CONTROLLING LIGHT EMISSION AMOUNT OF LIGHT-EMITTING UNIT

(71) Applicant: CANON KABUSHIKI KAISHA, Tokyo (JP)

(72) Inventor: Kohei Inamura, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 58 days.

(21) Appl. No.: 14/275,324

(22) Filed: May 12, 2014

(65) Prior Publication Data

US 2014/0340429 A1 Nov. 20, 2014

(30) Foreign Application Priority Data

May 14, 2013 (JP) ..... 2013-102286

(51) Int. Cl.
*G09G 3/32* (2016.01)
*G09G 3/34* (2006.01)

(52) U.S. Cl.
CPC ..... *G09G 3/3426* (2013.01); *G09G 2320/062* (2013.01); *G09G 2320/066* (2013.01)

(58) Field of Classification Search
CPC ..... G09G 3/3426; G09G 2320/066; G09G 2320/062
USPC ..... 345/690
See application file for complete search history.

(56) References Cited

U.S. PATENT DOCUMENTS

2007/0152926 A1* 7/2007 Kwon ..... G09G 3/3426 345/82
2007/0268242 A1* 11/2007 Baba ..... G09G 3/3406 345/102
2008/0266235 A1* 10/2008 Hupman ..... G09G 3/3406 345/102
2009/0115907 A1* 5/2009 Baba ..... G09G 3/3406 348/672
2010/0050005 A1* 2/2010 Fujiwara ..... H04N 5/63 713/320
2010/0302133 A1* 12/2010 Liang ..... G09G 3/3426 345/102
2013/0147862 A1* 6/2013 Atkins ..... G09G 3/3426 345/690

FOREIGN PATENT DOCUMENTS

WO 2009054223 A1 4/2009

* cited by examiner

*Primary Examiner* — Jonathan Blancha
(74) *Attorney, Agent, or Firm* — Cowan, Liebowitz & Latman, P.C.

(57) ABSTRACT

An image display apparatus includes: a light-emitting unit, a light emission amount of which is variably controllable; a display unit configured to display an image by modulating, according to image data, light emitted from the light-emitting unit; and a control unit configured to control the light emission amount of the light-emitting unit according to a maximum and a minimum of a pixel value in a frame. The control unit maximizes the light emission amount of the light-emitting unit irrespective of the maximum when the minimum is larger than a first threshold.

22 Claims, 5 Drawing Sheets

T1 T2
Fig.3A
INPUT IMAGE
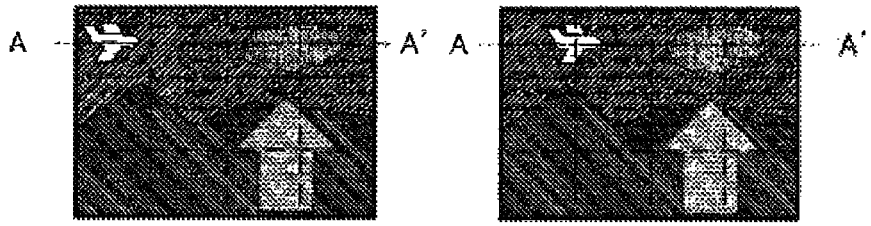
Fig.3B
MAXIMUM OF EACH BLOCK
| | | | |
|---|---|---|---|
| 255 | 120 | 160 | 160 |
| 120 | 120 | 200 | 200 |
| 20 | 20 | 200 | 200 |
| | | | |
|---|---|---|---|
| 255 | 255 | 160 | 160 |
| 120 | 120 | 200 | 200 |
| 20 | 20 | 200 | 200 |
Fig.3C
MINIMUM OF EACH BLOCK
| | | | |
|---|---|---|---|
| 120 | 120 | 120 | 120 |
| 20 | 20 | 20 | 20 |
| 20 | 20 | 20 | 20 |
| | | | |
|---|---|---|---|
| 120 | 120 | 120 | 120 |
| 20 | 20 | 20 | 20 |
| 20 | 20 | 20 | 20 |
Fig.3D
BACKLIGHT CONTROL VALUE LEVEL TO BE SELECTED (PRESENT INVENTION)
| | | | |
|---|---|---|---|
| 5 | 5 | 5 | 5 |
| 4 | 4 | 4 | 4 |
| 4 | 4 | 4 | 4 |
| | | | |
|---|---|---|---|
| 5 | 5 | 5 | 5 |
| 4 | 4 | 4 | 4 |
| 4 | 4 | 4 | 4 |
Fig.3E
BACKLIGHT CONTROL VALUE LEVEL TO BE SELECTED (RELATED ART)
| | | | |
|---|---|---|---|
| 5 | 2 | 4 | 4 |
| 2 | 2 | 4 | 4 |
| 1 | 1 | 4 | 4 |
| | | | |
|---|---|---|---|
| 5 | 5 | 4 | 4 |
| 2 | 2 | 4 | 4 |
| 1 | 1 | 4 | 4 |
Fig.3F
BACKLIGHT BRIGHTNESS DISTRIBUTION ON A-A' CROSS SECTION
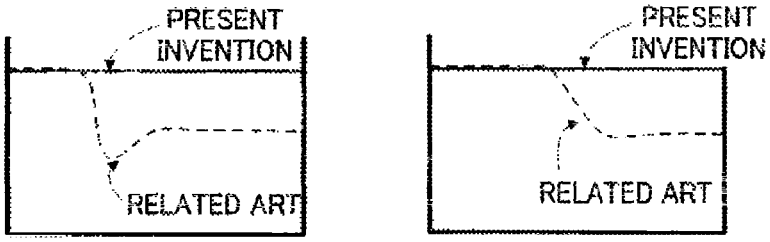

T1 T2 T3 T4

INPUT IMAGE

MAXIMUM OF EACH BLOCK

| | | | |
|---|---|---|---|
| 160 | 160 | 160 | 160 |
| 120 | 120 | 200 | 200 |
| 20 | 20 | 200 | 200 |

| | | | |
|---|---|---|---|
| 160 | 160 | 160 | 160 |
| 120 | 120 | 200 | 200 |
| 250 | 20 | 200 | 200 |

| | | | |
|---|---|---|---|
| 160 | 160 | 160 | 160 |
| 120 | 120 | 200 | 200 |
| 250 | 20 | 200 | 200 |

| | | | |
|---|---|---|---|
| 160 | 160 | 160 | 160 |
| 120 | 120 | 200 | 200 |
| 250 | 20 | 200 | 200 |

MINIMUM OF EACH BLOCK

| | | | |
|---|---|---|---|
| 15 | 15 | 120 | 120 |
| 20 | 20 | 20 | 20 |
| 20 | 20 | 20 | 20 |

| | | | |
|---|---|---|---|
| 120 | 15 | 120 | 120 |
| 20 | 20 | 20 | 20 |
| 20 | 20 | 20 | 20 |

| | | | |
|---|---|---|---|
| 120 | 15 | 120 | 120 |
| 20 | 20 | 20 | 20 |
| 20 | 20 | 20 | 20 |

| | | | |
|---|---|---|---|
| 120 | 15 | 120 | 120 |
| 20 | 20 | 20 | 20 |
| 20 | 20 | 20 | 20 |

BACKLIGHT CONTROL VALUE LEVEL TO BE SELECTED

| | | | |
|---|---|---|---|
| 3 | 3 | 5 | 5 |
| 4 | 4 | 4 | 4 |
| 4 | 4 | 4 | 4 |

| | | | |
|---|---|---|---|
| 3 | 3 | 5 | 5 |
| 4 | 4 | 4 | 4 |
| 5 | 4 | 4 | 4 |

| | | | |
|---|---|---|---|
| 4 | 3 | 5 | 5 |
| 4 | 4 | 4 | 4 |
| 5 | 4 | 4 | 4 |

| | | | |
|---|---|---|---|
| 4 | 5 | 5 | 5 |
| 4 | 4 | 4 | 4 |
| 5 | 4 | 4 | 4 |

IMAGE DISPLAY APPARATUS AND CONTROL METHOD THEREFOR FOR CONTROLLING LIGHT EMISSION AMOUNT OF LIGHT-EMITTING UNIT

BACKGROUND OF THE INVENTION

Field of the Invention

The present invention relates to an image display apparatus and a control method for the image display apparatus.

Description of the Related Art

In an image display apparatus including a backlight including a plurality of light-emitting blocks, light emission brightness of which can be individually controlled, there is a technique for reducing the light emission brightness of the backlight for each of the light-emitting blocks according to an input image signal. There is also a technique for reducing the light emission brightness of the backlight for each of the light-emitting blocks according to an input image signal and correcting an image signal of an image region corresponding to the light-emitting block according to the reduction of the light emission brightness. These techniques are called local dimming. By using the local dimming, it is possible to improve the contrast of a display image and suppress a misadjusted black level (see, for example, WO2009/054223).

SUMMARY OF THE INVENTION

In the conventional local dimming, the light emission brightness is controlled according to an input image for each of the light-emitting blocks to, when a maximum gradation value of an image region corresponding to each of the light-emitting blocks of the backlight is low, reduce the light emission brightness of the light-emitting block and, when the maximum gradation value is high, increase the light emission brightness. A pixel value (a gradation value) of the image region corresponding to the light-emitting block, the light emission brightness of which is reduced, is extended to prevent the display brightness of pixels in the image region from changing with respect to the brightness of the input signal. In this way, the light emission brightness of the light-emitting block is determined according to the maximum gradation value of one image region corresponding to the light-emitting block. Therefore, when the maximum gradation value of the image region greatly changes, the light emission brightness of the light-emitting block also greatly changes. This sometimes causes a flicker.

In WO2009/054223, by determining the light emission brightness of a light-emitting block on the basis of a weighted average of a maximum and an average of the brightness of pixels in an image region corresponding to the light-emitting block, a flicker is further suppressed compared with determining the light emission brightness on the basis of only the maximum. However, in the method of WO2009/054223, when the weight of the average in calculating the weighted average is larger than the weight of the maximum, the display brightness of the pixels having the maximum sometimes falls below the brightness of an input signal.

Therefore, the present invention provides a technique capable of suppressing a flicker in an image display apparatus that performs local dimming and suppressing deterioration in reproducibility of brightness.

According to a first aspect of the present invention, there is provided an image display apparatus including: a light-emitting unit, a light emission amount of which is variably controllable; a display unit configured to display an image by modulating, according to imago data, light emitted from the light-emitting unit; and a control unit configured to control the light emission amount of the light-emitting unit according to a maximum and a minimum of a pixel value in a frame. The control unit maximizes the light emission amount of the light-emitting unit irrespective of the maximum when the minimum is larger than a first threshold.

According to a second aspect of the present invention, there is provided a control method for an image display apparatus including: a light-emitting unit, a light emission amount of which is variably controllable; and a display unit configured to display an image by modulating, according to image data, light emitted from the light-emitting unit, the control method including: acquiring a maximum and a minimum of a pixel value in a frame; and controlling the light emission amount of the light-emitting unit according to the maximum and the minimum. In the controlling the light emission amount of the light-emitting unit, the light emission amount of the light-emitting unit is maximized irrespective of the maximum when the minimum is larger than a first threshold.

According to the present invention, it is possible to suppress a flicker in an image display apparatus that performs local dimming and suppressing deterioration in reproducibility of brightness.

Further features of the present invention will become apparent from the following description of exemplary embodiments (with reference to the attached drawings).

BRIEF DESCRIPTION OF THE DRAWINGS

FIGS. 3A to 3F are diagrams for explaining an operation in the first embodiment;

DESCRIPTION OF THE EMBODIMENTS

First Embodiment

A liquid crystal display apparatus and a control method for the liquid crystal display apparatus according to a first embodiment of the present invention are explained below. The liquid crystal display apparatus according to this embodiment includes a backlight including a plurality of light-emitting blocks, light emission brightness (a light emission amount) of which is variably controllable individually. The blocks are regions obtained by dividing a screen. For example, the blocks are regions obtained by dividing the screen into N (N is an integer equal to or larger than 2) in the horizontal direction and M (M is an integer equal to or larger than 2) in the vertical direction. The blocks may be regions obtained by dividing the screen only in the horizontal direction or may be regions obtained by dividing the screen only in the vertical direction.

Figure 1:
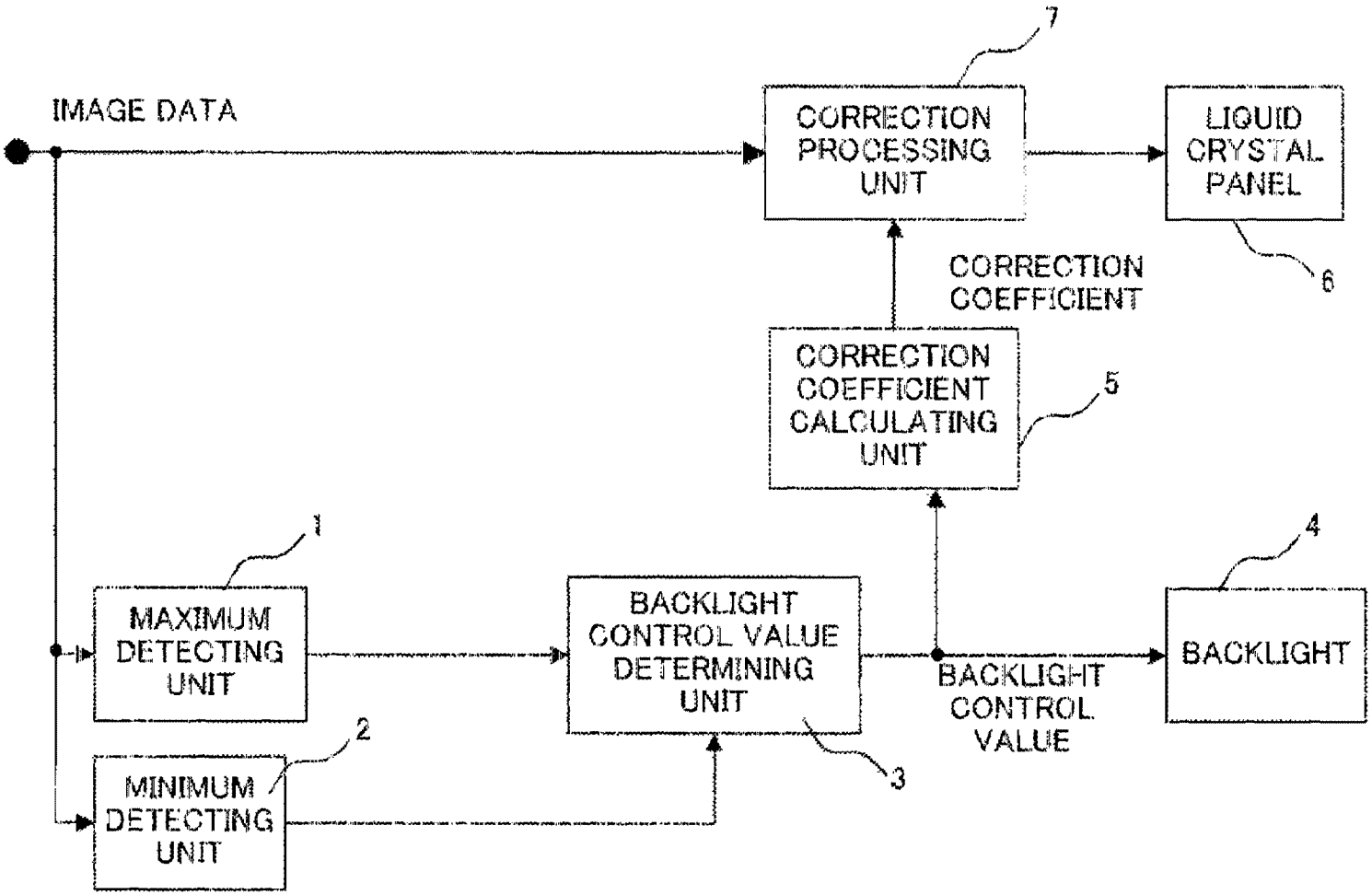
FIG. 1 is a block diagram showing an example of the functional configuration of a liquid crystal display apparatus according to a first embodiment.

FIG. 1 is a block diagram showing an example of the functional configuration of the liquid crystal display apparatus according to this embodiment.

Input image data (image signal) is sent to a maximum detecting unit 1 and a minimum detecting unit 2. The maximum detecting unit 1 acquires, for each of image regions corresponding to the blocks, a maximum of pixel values (gradation values) of pixels in the image region. The minimum detecting unit 2 acquires, for each of the image regions corresponding to the blocks, a minimum of the pixel values of the pixels in the image region. The maximum and the minimum of the pixel values for each of the blocks are sent to a backlight control value determining unit 3.

The backlight control value determining unit 3 determines a backlight control value for each of the blocks from the maximum and the minimum of the pixel values of each of the blocks. The backlight control value corresponds to the light emission brightness of the backlight. The backlight control value determining unit 3 determines the backlight control value according to a two-dimensional table shown in FIG. 2A. In this embodiment, the backlight control value is set according to a plurality of light emission levels decided according to light emission amounts. The light emission level takes any value among five stages of a level 1 to a level 5. The light emission brightness is the smallest at the level 1. The light emission brightness increases as the level rises. The light emission brightness is the largest at the level 5. The backlight control value determined by the backlight control value determining unit 3 is sent to a backlight 4 and a correction coefficient calculating unit 5.

The backlight 4 is a lighting device including a plurality of blocks. Each of the blocks includes one or a plurality of light sources. The backlight 4 irradiates a liquid crystal panel 6 from the back. The light emission brightness of each of the blocks can be independently controlled. The light emission brightness of each of the blocks is controlled according to a signal (a backlight control value) output by the backlight control value determining unit 3. The liquid crystal panel 6 transmits light emitted from the backlight 4 at transmittance determined for each of pixels, whereby an observable image is displayed on the screen.

The liquid crystal panel 6 displays an image by modulating, according to image data, the light emitted from the backlight 4. Image data is input to the liquid crystal panel 6 via a correction processing unit 7. A correction coefficient calculated by a correction coefficient calculating unit 5 is input to the correction processing unit 7. The correction processing unit 7 corrects the image data on the basis of the correction coefficient. The correction coefficient calculating unit 5 calculates a brightness distribution of the backlight on the basis of a signal (a backlight control value) output by the backlight control value determining unit 3 and corrects, on the basis of the brightness distribution, the image data such that the brightness of transmitted light is brightness corresponding to a pixel value of the input image data.

Figure 2A:
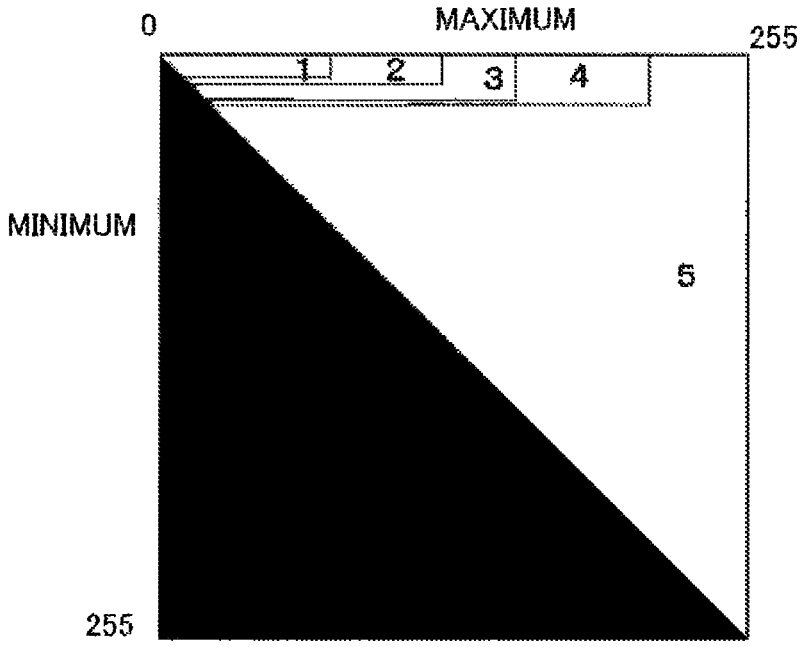
FIGS. 2A and 2B are diagrams for explaining a two-dimensional table of a backlight control value determining unit 3.

The two-dimensional table shown in FIG. 2A is explained in detail.

In the image display apparatus in this embodiment, a relation (a gradation brightness characteristic) between an output brightness value (a display brightness value) L of the liquid crystal panel 6 and an input signal (a pixel value) S is indicated by the following expression when it is assumed that the gradation of the pixel value is 8 bits (0 to 255 gradations):

$$L=K1+(W5-K1)\times(S/255)^{\gamma} \quad \text{(Expression 1)}$$

where, K1 represents a display brightness value obtained when the backlight control value is the level 1 and a liquid crystal input pixel value is 0 gradation and W5 represents a display brightness value obtained when the backlight control value is the level 5 and the liquid crystal input pixel value is 255 gradation. γ represents a gamma value of the image display apparatus and is 2.2 in this embodiment.

When control gains Gx at the respective backlight control value levels x are represented as G1=0.067, G2=0.2, G3=0.33, G4=0.67, and G5=1, an input signal S' and a display brightness value L at each of the levels are indicated by the following expression:

$$L=Gx\times\{K5+(W5-K5)\times(S'/255)^{\gamma}\} \quad \text{(Expression 2)}$$

where, K5 represents a display brightness value obtained when the backlight control value is the level 5 and the liquid crystal input pixel value is 0 gradation.

A brightness range displayable by the image display apparatus when the input signal is changed between 0 and 255 at each of the backlight control value levels is calculated from Expression 2. A gradation range corresponding to the displayable brightness range is calculated from Expression 1.

For example, when it is assumed that W5=1 and K5=0.005, the displayable brightness range in the case of the backlight control value level 1 is calculated as 0.000335 to 0.067 from Expression 2. A gradation range corresponding to the brightness range is calculated as 0 to 74 from Expression 1. Similarly, a gradation range corresponding to the brightness range displayable at each of the backlight control value levels (hereinafter referred to as displayable gradation range) is 10 to 122 at the level 2, 13 to 154 at the level 3, 19 to 212 at the level 4, and 23 to 255 at the level 5.

If the block is caused to emit light at the backlight control value level at which both of the minimum and the maximum of the pixel values of the pixels in the image region corresponding to the block are included in the displayable gradation range, it is possible to display all the pixels in the image region corresponding to the block at correct brightness.

In the case of this embodiment, displayable gradation ranges respectively corresponding to the five backlight control value levels overlap one another. Therefore, depending on a combination of the maximum and the minimum, in some case, there are a plurality of backlight control value levels at which the brightness of all the pixels in the image region corresponding to the block can be correctly displayed. On the other hand, depending on a combination of the maximum and the minimum, in some case, there could be no backlight control value level at which both of the minimum and the maximum are included in the displayable gradation range.

Therefore, in this embodiment, a backlight control value level of each of the blocks is determined as explained below on the basis of a maximum and a minimum of pixel values of pixels in an image region corresponding to the block.

(A) A backlight control value level is selected at which the maximum is included in a displayable gradation range and a portion common to a displayable gradation range and a range from the minimum to the maximum is the widest.

(B) When there are a plurality of backlight control value levels that satisfy the condition (A), a maximum backlight control value level among the backlight control value levels is selected.

By determining the backlight control value level as explained above, it is possible to suppress the display brightness of a pixel, a pixel value of which is the maximum, in the image region corresponding to each of the blocks from becoming low with respect to the pixel value. Therefore, it is possible to suppress deterioration in brightness reproducibility.

The two-dimensional table shown in FIG. 2A shows a relation between a combination of a maximum and a minimum of pixel values of pixels in an image region corresponding to a block and a backlight control value level that satisfies the above conditions. By selecting a backlight control level from the combination of the maximum and the minimum of the pixel values on the basis of FIG. 2A, it is possible to determine a backlight control value level that satisfies the two conditions. In FIG. 2A, the ordinate represents the minimum and the abscissa represents the maximum. Since the minimum does not exceed the maximum, a region painted in black in the lower left half of the table does not have a value.

Figure 2B:
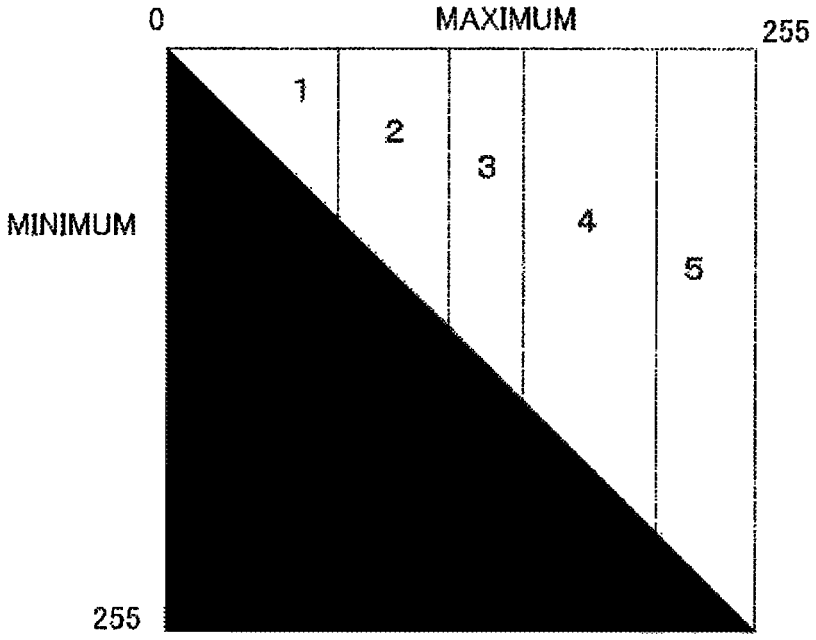

As shown in FIG. 2A, in this embodiment, the light emission brightness of the block is determine on the basis of not only the maximum but also the minimum of the pixel values of the pixels in the image region corresponding to the block. It is seen that, when the minimum is larger than a certain threshold, a backlight control value of the block is set to a maximum level irrespective of the maximum. The threshold in this case is a lower limit value of a gradation range displayable when the block is caused to emit light with the backlight control value set to the maximum level. For example, even between blocks having an equal maximum, the light emission brightness of the blocks is higher as a minimum is larger. Conventionally, the light emission brightness of the block is determined on the basis of only the maximum. Therefore, the blocks having the equal maximum always have the same light emission brightness. In FIG. 2B, such a determination method of light emission brightness of a block in the related art is represented as a two-dimensional table same as FIG. 2A for comparison. As shown in FIG. 2B, in the relate art, a backlight control value level is determined on the basis of only the maximum. Therefore, if the maximum is the same, the determined backlight control value is the same irrespective of which value the minimum is.

A specific example of the determination method for a backlight control value in this embodiment is explained with reference to FIGS. 3A to 3F. In FIGS. 3A to 3F, T1 and T2 represent continuous frames.

FIG. 3A shows an input image.

FIG. 3B shows maximums of pixel values of pixels in image regions corresponding to blocks of the input image. FIG. 3C shows minimums of the pixel values of the pixels in the image regions corresponding to the blocks of the input image.

FIG. 3D shows backlight control value levels of the blocks determined according to the maximums shown in FIG. 3A and the minimums shown in FIG. 3B on the basis of the table shown in FIG. 2A.

FIG. 3E shows the related art for reference and shows backlight control value levels determined according to only the maximums shown in FIG. 3A on the basis of the table shown in FIG. 2B.

FIG. 3F shows a backlight brightness distribution on an A-A' cross section shown in FIG. 3A obtained when the blocks of the backlight are caused to emit light according to the determined backlight control value levels. In FIG. 3F, a solid line indicates the present invention (based on FIG. 3D) and a broken line indicates the related art (based on FIG. 3E).

In a second block from the left in a first row in FIG. 3A, the maximum greatly changes (from 120 to 255) in T1 to T2. However, the minimum does not change (from 120 to 120). Since the minimum is large, the backlight control value level determined by the two-dimensional table shown in FIG. 2A is the level 5 in both of T1 and T2. There is no change between the frames. Therefore, as indicated by the solid line in FIG. 3F, a brightness change is small between the frames and a flicker less easily occurs.

On the other hand, when a backlight control value level is determined according to only a maximum as in the related art, the backlight control value level greatly changes from 2 to 5 according to a change of the maximum. Therefore, as indicated by the broken line in FIG. 3F, a brightness change is large between the frames. This causes a flicker.

When FIG. 2A showing this embodiment and FIG. 2B showing the related art are compared, in FIG. 2A, an area of the backlight control value level 5 is wider. In more cases than in the related art, when the minimum is large to a certain degree, the backlight control value level does not change even if the maximum and the minimum change. That is, since a change in the light emission brightness of the block is suppressed, it is possible to suppress a flicker.

In this embodiment, the backlight control value levels are five levels. However, the backlight control value levels are not limited to this and may be set finer. When the backlight control value levels are finer, a change in light emission brightness at the time when the backlight control value level changes decreases. Therefore, it is possible to more effectively suppress a flicker. Even when the backlight control value levels are set finer, a flicker involved in a change of the maximum and the minimum of the pixel values is suppressed by increasing a ratio of the highest backlight control value level on the table as shown in FIG. 2A.

As explained above, according to this embodiment, the light emission brightness is controlled according to the minimum and the maximum of the pixel values of each of the blocks such that a change in the backlight control value level involved in a change in the maximum and the minimum decreases. Therefore, it is possible to realize local dimming with a flicker suppressed. Since a backlight control value level at which brightness of a pixel, a pixel value of which is the maximum, is displayable is selected, it is possible to suppress deterioration in brightness reproducibility.

Second Embodiment

In a second embodiment, an example is explained in which a flicker is further suppressed with respect to a change in a minimum and a maximum of pixel values of each of blocks.

Figure 4:
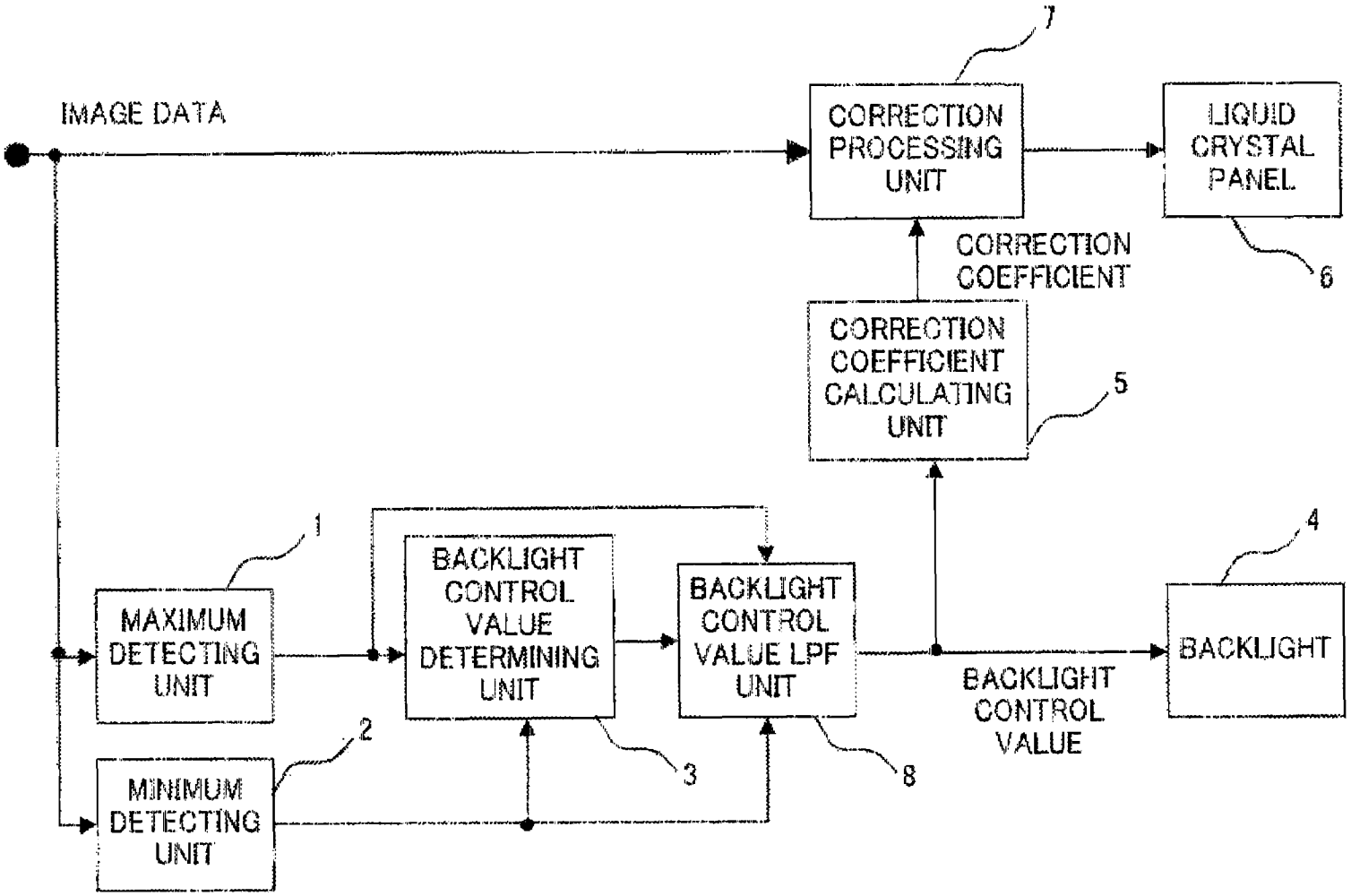
FIG. 4 is a block diagram showing an example of the functional configuration of a liquid crystal display apparatus according to a second embodiment.

FIG. 4 is a block diagram showing an example of the functional configuration of a liquid crystal display apparatus according to this embodiment. Components having functions same as the functions in the first embodiment are denoted by the same reference numerals and explanation of the components is omitted. The second embodiment is different from the first embodiment only in that a backlight control value LPF unit 8 is added in a post stage of the backlight control value determining unit 3. The LPF represents a low pass filter and the backlight control value LPF unit 8 operates as a time LPF.

A minimum output from the minimum detecting unit 2, a maximum output from the maximum detecting unit 1, and a backlight control value output from the backlight control value determining unit 3 are input to the backlight control value LPF unit 8. The backlight control value LPF unit 8 outputs the backlight control value subjected to time LPF processing.

The backlight control value LPF unit 8 is explained below.

A backlight control value is determined by the backlight control value determining unit 3 on the basis of the two-dimensional table shown in FIG. 2A according to a minimum and a maximum of pixel values of each of blocks. When the minimum and the maximum of the pixel values greatly change according to a change of an input image, the backlight control value sometimes greatly changes. For example, when a maximum 50 and a minimum 5 change to a maximum 220 and a minimum 40, a backlight control value level greatly changes from 1 to 5.

The backlight control value LPF unit 8 suppresses a sudden change in the backlight control value. Specifically, the backlight control value LPF unit 8 stores a backlight control value of the preceding frame and compares a backlight control value determined anew in the present frame and the backlight control value of the preceding frame. When an amount of change in the backlight control value level is larger than a threshold Th, the backlight control value LPF unit 8 reduces the change amount to be equal to or smaller than the threshold Th.

For example, when it is assumed that the threshold Th is 1, the backlight control value of the preceding frame is 1, and the backlight control value determined anew in she present frame is 5, a difference between the backlight control values is 4, which is larger than the threshold Th (=1). In this case, the change amount is reduced to 1. The backlight control value level applied to the present frame is changed to 2. A threshold for determining whether processing for reducing the amount of change in the backlight control value in this way is performed is hereinafter referred to as change amount threshold (second threshold). In this embodiment, when the amount of change in the backlight control value is larger than the change amount threshold, the backlight control value applied to the present frame is changed (corrected) such that the amount of change in the backlight control value is equal to or smaller than the change amount threshold (equal to or smaller than the second threshold).

In this embodiment, further, the backlight control value LPF unit 8 varies the threshold according to whether the change in the backlight control value level is involved in the change in the maximum or the change in the minimum and according to whether the change is an increasing change or a decreasing change. Specifically, when the maximum increases or the minimum decreases, the backlight control value LPF unit 8 sets the backlight control value to quickly change. When the minimum increases or the maximum decreases, the backlight control value LPF unit 8 sets the backlight control value to slowly change.

This is because, concerning pixel values of each of the blocks, even if the minimum of the present frame increases with respect to the minimum of the preceding frame, if the maximum does not increase, pixels of the present frame can be displayed at the backlight control value level of the preceding frame. That is, an influence on brightness reproducibility is small even if an increase in the backlight control value level is delayed with respect to the increase in the minimum. Similarly, concerning the pixel values of each of the blocks, even if the maximum of the present frame decreases with respect to the maximum of the preceding frame, if the minimum does not decrease, pixels of the present frame can be displayed at the backlight control value level of the preceding frame. That is, an influence on brightness reproducibility is small even if a decrease in the backlight control value level is delayed with respect to the decrease in the minimum.

Specifically, the backlight control value LPF unit 8 stores the minimum and the maximum of the preceding frame concerning the pixel values of each of the blocks. When an increase amount of the maximum is larger than a threshold (a third threshold) or a decrease amount of the minimum is larger than the threshold (the third threshold), the backlight control value LPF unit 8 sets the change amount threshold Th to Th_high. When the increase amount of the maximum is equal to or smaller than the threshold (equal to or smaller than the third threshold) or the decrease amount of the minimum is equal to or smaller than the threshold (equal to or smaller than the third threshold), the backlight control value LPF unit 8 sets the change amount threshold Th to Th_low (<Th_high). When both of the increase amount of the maximum and the decrease amount of the minimum are equal to or smaller than the threshold (equal to or smaller than the third threshold), the backlight control value LPF unit 8 uses the change amount threshold (the second threshold) of the preceding frame as it is. When the amount of change in the backlight control value of the present frame with respect to the preceding frame is larger than the change amount threshold, the backlight control value LPF unit 8 sets, as a backlight control value applied to the present frame, a value obtained by adding the change amount threshold to the backlight control value of the preceding frame. Consequently, when the amount of change in the backlight control value is large, change speed of the backlight control value is reduced. When the change in the backlight control value is involved in a large increase in the maximum or a large decrease in the minimum, the backlight control value changes at high speed while being reduced.

The change amount thresholds Th_high and Th_low are not limited to integer values and may be fractional values. The backlight control value LPF unit 8 calculates the backlight control value as a fractional value and retains a value of the preceding frame. A backlight control value obtained by converting the fractional value into an integer value (by, for example, rounding-off) is sent to the backlight 4 and the correction coefficient calculating unit 5.

A specific example is explained with reference to FIGS. 5A to 5D. In FIGS. 5A to 5D, T1 and T4 represent continuous frames.

Figures 5A, 5B, 5C, 5D:
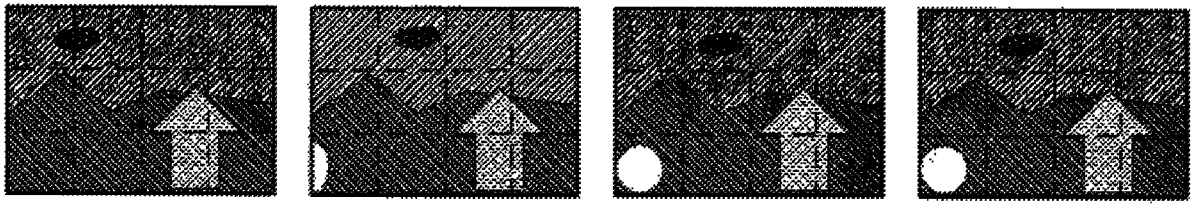
FIGS. 5A to 5D are diagrams for explaining an operation in the second embodiment.

FIG. 5A shows an input image.

FIG. 5B shows maximums of pixel values of pixels in image regions corresponding to blocks of the input image. FIG. 5C shows minimums of the pixel values of the pixels in the image regions corresponding to the blocks of the input image.

FIG. 5D shows backlight control value levels determined concerning the blocks.

In this embodiment, the threshold of the maximum change is set to 30, the threshold of the minimum change is set to 5, the change amount threshold Th_high of the backlight control value is set to 1, and the change amount threshold Th_low of the backlight control value is set to 0.4.

In an upper left block surrounded by a circle in FIGS. 5B to 5D, the maximum does not change (from 160 to 160) and the minimum changes (from 15 to 120) in T1 to T2. When a backlight control value is determined on the basis of the table shown in FIG. 2A, the backlight control value of the block changes from the level 3 to the level 5 in T1 to T2. Since this is an increase in the minimum, the change amount threshold Th of the backlight control value is Th_low=0.4. Since the amount of change in the backlight control value is 2 from the level 3 to the level 5, the change amount is larger than the change amount threshold Th_low. Therefore, a value 3+0.4=3.4 obtained by adding the change amount threshold Th_low to the backlight control value of the preceding frame is set as a backlight control value of the present frame. A backlight control value output from the backlight control value LPF unit 8 is calculated as the level 3 by rounding off 3.4. However, the backlight control value LPF unit 8 stores the value 3.4 obtained by adding the change amount threshold Th_low to the backlight control value of the preceding frame.

Both of the maximum and the minimum or the block do not change in T2 to T3. Therefore, the change amount threshold Th remains at Th_low=0.4. Since the maximum is 160 and the minimum is 120 in the block, the backlight control value determined by the backlight control value determining unit 3 on the basis of the table shown in FIG. 2A is the level 5. The backlight control value LPF unit 8 compares the stored backlight control value 3.4 in the preceding frame T2 and the backlight control value 5 of the present frame. In this case, a change amount (5−3.4=1.6) of the backlight control values is larger than the change amount threshold Th_low (=0.4). Therefore, the backlight control value LPF unit 8 sets, as a backlight control value of the present frame T3, a value (3.8) obtained by adding the change amount threshold Th_low (0.4) to the backlight control value (3.4) of the preceding frame. A backlight control value to be output is a value 4 obtained by rounding off the calculated value (3.8). Further, in T4, the maximum and the minimum of the block do not change from those in T3. A backlight control value determined on the basis of the table shown in FIG. 2A is the level 5. Since the backlight control value of the preceding frame T3 stored in the backlight control value LPF unit 8 is 3.8, a change amount is 1.2, which is larger than the change amount threshold 0.4. Therefore, a value 4.2 obtained by adding the change amount threshold 0.4 so the backlight control value 3.8 of the preceding frame is a backlight control value of the present frame. A value 4 obtained by rounding off the backlight control value is output. Therefore, the backlight control value of the block in the frames T1 to T4 is changes to 3, 5, 5, and 5 if LPF processing by the backlight control value LPF unit 8 is not performed. However, since the LPF processing is performed, the backlight control value slowly changes to 3, 3, 4, and 4.

On the other hand, in a lower left block surrounded by a square in FIGS. 5B to 5D, the minimum does not change (from 20 to 20) and the maximum increases (from 20 to 250) in T1 to T2. Since this is an increase in the maximum and an increase amount (250−20=230) of the maximum is equal to or larger than the threshold (30), the change threshold Th of the backlight control value is set to Th_high=1.

A backlight control value of T2 determined on the basis of the table shown in FIG. 2A from the minimum (20) and the maximum (250) is the level 5. A change amount 1 from the level 4, which is a backlight control value of the preceding frame T1, is equal to or smaller than the change amount threshold 1. Therefore, processing for reducing the backlight control value is not performed. A backlight control value of the frame T2 remains at the value determined on the basis of the table shown in FIG. 2A, that is, the level 5.

According to this embodiment, when a slow change in a backlight control value causes a brightness fall (insufficiency of brightness) and gradation collapse, for example, when the maximum increases or the minimum decreases, changing speed of the backlight control value is less easily reduced. Consequently, the brightness fall and the gradation collapse are suppressed. Otherwise, a sudden change in the backlight control value is further suppressed than in the first embodiment. Therefore, it is possible to more effectively suppress a flicker.

As explained above, according to this embodiment, light emission brightness is controlled according to the minimum and the maximum of the pixel values of each of the blocks such that a change in a backlight control value level involved in a change of the maximum and the minimum decreases. Therefore, it is possible to realize local dimming with a flicker suppressed. Since a backlight control value level at which brightness of a pixel, a pixel value of which is the maximum, is displayable is selected, it is possible to suppress deterioration in brightness reproducibility.

The embodiments are examples in which the present invention is applied to the image display apparatus in which the backlight includes the plurality of light-emitting blocks and a light emission amount can be variably controlled independently for each of the light-emitting blocks. However, the present invention can also be applied to an image display apparatus having a configuration in which the backlight is not divided by light-emitting blocks. In this case, the control in the embodiments can be applied without any modification, on the premise that the number of divisions by the light-emitting blocks of the backlight in the embodiments is 1. In this way, in the case of the image display apparatus that performs brightness control of the backlight uniformly over the entire screen, the maximum detecting unit 1 and the minimum detecting unit 2 detect a maximum and a minimum of pixel values in a frame of image data. By applying the present invention to such an image display apparatus, the effects of a reduction in a flicker and suppression of deterioration in brightness reproducibility are obtained. The embodiments are examples in which the present invention is applied to the image display apparatus including the liquid crystal panel. However, the liquid crystal panel is an example of a display panel. In the image display apparatus of the present invention, the display panel is not limited to the liquid crystal panel.

OTHER EMBODIMENTS

Embodiments of the present invention can also be realized by a computer of a system or apparatus that reads out and executes computer executable instructions recorded on a storage medium (e.g., non-transitory Computer-readable storage medium) to perform the functions of one or more of the above-described embodiment(s) of the present invention, and by a method performed by the computer of the system or apparatus by, tor example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-102286, filed on May 14, 2013, which is hereby incorporated by reference herein in its entirety.

What is claimed is:

1. An image display apparatus comprising:

a light-emitting unit configured to emit light;

a display unit configured to display an image of a frame by modulating light emitted from the light-emitting unit; and a control unit configured to control the light emission amount of the light-emitting unit according to a maximum pixel value of pixel values in the frame and a minimum pixel value of pixel values in the frame, wherein in a case where the minimum pixel value is larger than a first threshold, which is a value based on a lower limit value in a range of pixel values displayable in the display unit in a case where the light emission amount of the light-emitting unit is maximized, the control unit controls the light emission amount of the light-emitting unit with a maximum light emission amount of the light-emitting unit, irrespective of the maximum pixel value of pixel values in the frame, and in a case where the minimum pixel value is equal to or smaller than the first threshold, the control unit controls the light emission amount of the light-emitting unit on the basis of the maximum pixel value of pixel values in the frame.

2. The image display apparatus according to claim 1, wherein, in a case where the minimum pixel value is equal to or smaller than the first threshold, the control unit sets the light emission amount of the light-emitting unit such that the maximum pixel value is included in a displayable range which is a range of pixel values displayable in the display unit in a case where the light-emitting unit emits light with the light emission amount of the light-emitting unit.

3. The image display apparatus according to claim 1, wherein the control unit controls the light emission amount of the light-emitting unit by selecting any one of a plurality of light emission levels determined according to light emission amounts.

4. The image display apparatus according to claim 3, wherein the control unit selects, among the plurality of light emission levels, a light emission level that satisfies a condition under which the maximum pixel value is included in a range of pixel values displayable in the display unit in a case where the light-emitting unit is caused to emit light at the light emission level and under which a portion common to the range of the displayable pixel values and a range from the minimum pixel value to the maximum pixel value is largest.

5. The image display apparatus according to claim 4, wherein, in a case where there are a plurality of the light emission levels that satisfy the condition, the control unit selects a highest light emission level among the light emission levels.

6. The image display apparatus according to claim 1, where, in a case where an amount of change in the light emission amount between a first frame and a second frame is larger than a second threshold, the control unit corrects a light emission amount determined in the second frame such that the amount of change in the light emission amount between the first frame and the second frame is equal to or smaller than the second threshold.

7. The image display apparatus according to claim 6, wherein the second threshold used for determination of the amount of change in the light emission amount, in a case where the maximum is increased and in a case where the minimum is decreased between the frames, is larger than the second threshold used for determination of the amount of change in the light emission amount in a case where the maximum is decreased and the minimum is increased between the frames.

8. The image display apparatus according to claim 7, wherein the second threshold used for determination of the amount of change in the light emission amount in a case where an increase amount of an increase in the maximum or a decrease amount of a decrease in the minimum between the frames is larger than a third threshold is larger than the second threshold used for determination of the amount of change in the light emission amount in a case where the increase amount or the decrease amount is equal to or smaller than the third threshold.

9. The image display apparatus according to claim 8, wherein, in a case where the increase amount is equal to or smaller than the third threshold and the decrease amount is equal to or smaller than the third threshold, the second threshold used for determination of the amount of change in the light emission amount in the first frame is also used for determination of the amount of change in the light emission amount in the second frame.

10. The image display apparatus according to claim 1, wherein the light-emitting unit includes a plurality of light-emitting blocks, light emission amounts of which are variably controllable individually, and the control unit performs the control of the light emission amount of the light-emitting unit by controlling a light emission amount for each of the light-emitting blocks according to pixel values in respective image regions corresponding to the respective light-emitting blocks.

11. The image display apparatus according to claim 1, wherein, in a case where the minimum pixel value is equal to or smaller than the first threshold, the control unit sets the light emission amount of the light-emitting unit such that the maximum pixel value is included in a displayable range which is a range of pixel values displayable in the display unit in a case where the light-emitting unit emits light with the light emission amount of the light-emitting unit and an intersection of the displayable range and a range from the minimum pixel value to the maximum pixel value is largest.

12. A control method for an image display apparatus including:

a light-emitting unit configured to emit light; and a display unit configured to display an image of a frame by modulating light emitted from the light-emitting unit, the control method comprising:

acquiring pixel values in the frame; and controlling the light emission amount of the light-emitting unit according to a maximum pixel value of pixel values in the frame and a minimum pixel value of the pixel values in the frame, wherein in the controlling the light emission amount of the light-emitting unit, in a case where the minimum pixel value is larger than a first threshold, which is a value based on a lower limit value in a range of pixel values displayable in the display unit in a case where the light emission amount of the light-emitting unit is maximized, the light emission amount of the light-emitting unit is controlled with a maximum light emission amount of the light-emitting unit, irrespective of the maximum pixel value of pixel values in the frame, and in a case where the minimum pixel value is equal to or smaller than the first threshold, the control unit controls the light emission amount of the light-emitting unit on the basis of the maximum pixel value of pixel values in the frame.

13. The control method for an image display apparatus according to claim 12, wherein, in the controlling the light emission amount of the light-emitting unit, in a case where the minimum pixel value is equal to or smaller than the first threshold, the light emission amount of the light-emitting unit is set such that the maximum pixel value is included in a displayable range which is a range of pixel values displayable in the display unit in a case where the light-emitting unit emits light with the light emission amount of the light-emitting unit.

14. The control method for an image display apparatus according to claim 12, wherein, in the controlling the light emission amount of the light-emitting unit, the light emission amount of the light-emitting unit is controlled by selecting any one of a plurality of light emission levels determined according to light emission amounts.

15. The control method for an image display apparatus according to claim 14, wherein, in the controlling the light emission amount of the light-emitting unit, among the plurality of light emission levels, a light emission level is selected that satisfies a condition under which the maximum pixel value is included in a range of pixel values displayable in the display unit in a case where the light-emitting unit is caused to emit light at the light emission level and under which a portion common to the range of the displayable pixel values and a range from the minimum pixel value to the maximum pixel value is largest.

16. The control method for an image display apparatus according to claim 15, wherein, in the controlling the light emission amount of the light-emitting unit, in a case where there are a plurality of the light emission levels that satisfy the condition, a highest light emission level among the light emission levels is selected.

17. The control method for an image display apparatus according to claim 12, where, in the controlling the light emission amount of the light-emitting unit, in a case where an amount of change in the light emission amount between a first frame and a second frame is larger than a second threshold, a light emission amount determined in the second frame is corrected such that the amount of change in the light emission amount between the first frame and the second frames is equal to or smaller than the second threshold.

18. The control method for an image display apparatus according to claim 17, wherein the second threshold used for determination of the amount of change in the light emission amount in a case where the maximum is increased and in a case where the minimum is decreased between the frames is larger than the second threshold used for determination of the amount of change in the light emission amount in a case where the maximum is decreased and the minimum is increased between the frames.

19. The control method for an image display apparatus according to claim 18, wherein the second threshold used for determination of the amount of change in the light emission amount in a case where an increase amount of an increase in the maximum or a decrease amount of a decrease in the minimum between the frames is larger than a third threshold is larger than the second threshold used for determination of the amount of change in the light emission amount in a case where the increase amount or the decrease amount is equal to or smaller than the third threshold.

20. The control method for an image display apparatus according to claim 19, wherein, in a case where the increase amount is equal to or smaller than the third threshold and the decrease amount is equal to or smaller than the third threshold, the second threshold used for determination of the amount of change in the light emission amount in the first frame is also used for determination of the amount of change in the light emission amount in the second frame.

21. The control method for an image display apparatus according to claim 12, wherein the light-emitting unit includes a plurality of light-emitting blocks, light emission amounts of which are variably controllable individually, and in the controlling the light emission amount of the light-emitting unit, the control of the light emission amount of the light-emitting unit is performed by controlling a light emission amount for each of the light-emitting blocks according to pixel values in respective image regions corresponding to the respective light-emitting blocks.

22. The control method for an image display apparatus according to claim 12, wherein, in the controlling the light emission amount of the light-emitting unit, in a case where the minimum pixel value is equal to or smaller than the first threshold, the light emission amount of the light-emitting unit is set such that the maximum pixel value is included in a displayable range which is a range of pixel values displayable in the display unit in a case where the light-emitting unit emits light with the light emission amount of the light-emitting unit and an intersection of the displayable range and a range from the minimum pixel value to the maximum pixel value is largest.

* * * * *